United States Patent [19]

Sharp et al.

[11] Patent Number: 4,528,898

[45] Date of Patent: Jul. 16, 1985

[54] FUME HOOD CONTROLLER

[75] Inventors: Gordon P. Sharp, Newton; William P. Curtiss, Winthrop; George B. Yundt, Cambridge, all of Mass.

[73] Assignee: IMEC Corporation, Boston, Mass.

[21] Appl. No.: 586,007

[22] Filed: Mar. 5, 1984

[51] Int. Cl.[3] ..... F24F 11/00

[52] U.S. Cl. ..... 98/115.3; 98/115.1

[58] Field of Search ..... 98/115 LH, 115 R, 39; 236/49

[56] References Cited

U.S. PATENT DOCUMENTS 4,031,819 6/1977 Applewhite ..... 98/115 R 4,160,407 7/1979 Duym ..... 98/115 R

*Primary Examiner*—William E. Wayner

*Assistant Examiner*—John M. Sollecito

*Attorney, Agent, or Firm*—Lee & Hollander

[57] ABSTRACT

A fume hood controller system in which the sash position is monitored by a transducer which provides a signal indicative of the area of the hood opening. A variable speed controller responsive to the sash position signal to provides a fan speed which varies as a function of the sash opening. An optional circuit monitors the power drawn by the motor and compares the actual power drawn by the motor with the expected power for the present sash position. If the actual power falls below the threshold, an alarm signal is generated indicating a reduced air flow in the fume hood. Additionally, motor overload may be detected by comparing the motor speed control signal with the actual motor speed. An alternate embodiment is shown in which the present invention may be used to control a single blower which exhausts a plurality of fume hoods while maintaining a substantially constant face velocity in each hood.

25 Claims, 17 Drawing Figures

FUME HOOD CONTROLLER

FIELD OF THE INVENTION

This invention is related to laboratory fume hoods, and more specifically to controllers for maintaining a constant face velocity in a fume hood as the sash is raised and lowered.

BACKGROUND OF THE INVENTION

A laboratory fume hood is a ventilated enclosure where harmful materials can be handled safely. The hood captures contaminants and prevents them from escaping into the laboratory by using an exhaust blower to draw air and contaminants in and around the hood's work area away from the operator so that inhalation of and contact with the contaminants are minimized. Access to the interior of the hood is through an opening which is closed with a sash which typically slides up and down to vary the opening into the hood.

The velocity of the air flow through the hood opening is called the face velocity. The more hazardous the material being handled, the higher the recommended face velocity, and guidelines have been established relating face velocity to toxicity. Typical minimum face velocities for laboratory fume hoods are 75 to 150 feet per minute (fpm), depending upon the application.

When an operator is working in the hood, the sash is opened to allow free access to the materials inside. The sash may be opened partially or fully, depending on the operations to be performed in the hood. While fume hood and sash sizes vary, the opening provided by a fully opened sash is on the order of ten square feet. Thus the maximum air flow which the blower must provide is typically on the order of 750 to 1500 cubic feet per minute (cfm).

The sash is closed when the hood is not being used by an operator. It is common to store hazardous materials inside the hood when the hood is not in use, and a positive airflow must therefore be maintained to exhaust contaminants from such materials even when the hood is not in use and the sash is closed.

It is important that the face velocity be kept as constant as possible. The minimum acceptable face velocity is determined by the level of hazard of the materials being handled, as discussed above. Too high a face velocity may cause turbulence, however, which can result in contaminants escaping from the hood. Additionally, high face velocities can be annoying to the operator and can damage fragile apparatus in the hood. As the hazard level of the materials being handled and the resulting minimum face velocity increases, maintaining a safe face velocity becomes more difficult.

Another important consideration in the design of a fume hood system is the cost of running the system. There are three major areas of costs: the capital expenditure of installing the hood, the cost of power to operate the hood exhaust blower, and the cost of heating, cooling, and delivering the "make-up air," which replaces the air exhausted from a room by the fume hood. For a hood operating continuously with an opening of 10 square feet and a face velocity of 100 fpm, the cost of heating and cooling the make-up air, for example, could run as high as fifteen hundred dollars per year in the northeastern United States. Where chemical work is done, large numbers of fume hoods may be required. For example, the Massachusetts Institute of Technology has approximately 650 fume hoods, most of which are in operation 24 hours per day.

Reliability is another important factor in the design of a fume hood system. It is important that the face velocity of a fume hood not be allowed to go below a certain level. The amount of air being exhausted from a hood may be decreased by many common occurrences: duct blockage, fan belt slippage or breakage, deterioration of the blower blades, especially where corrosive materials are being handled, motor overload, and other factors. A reduction in air flow reduces the face velocity, and it is important to take immediate steps when a low flow condition occurs to prevent escape of contaminants from the hood.

A conventional fume hood consists of an enclosure which forms five sides of the hood and a hood sash which slides up and down to provide a variable-sized opening on the sixth side. In this type of hood, the amount of air exhausted by the hood blower is essentially fixed, and the face velocity increases as the area of the sash opening decreases. As a result, the sash must be left open an appreciable amount even when the hood is not being used by an operator to allow air to enter the hood opening at a reasonable velocity.

To maintain a more constant face velocity as the hood sash is moved up and down, so-called "by-pass" hoods have been developed. A by-pass hood has a by-pass opening through which air can enter the fume hood. The by-pass opening is blocked by the sash when it is in the fully opened position. As the sash is lowered, the by-pass opening is gradually uncovered so that air can "by-pass" the hood opening and enter the hood directly, thus preventing the air velocity through the hood opening from becoming too high as the sash is closed.

In known types of fume hoods having a fixed fan speed, the air flow in the hood system may be monitored, for example by means of a flow sensor in the exhaust duct, to determine if the air flow and hence face velocity is below a selected value. It has proven difficult to provide sensors which reliably monitor the performance of a fume hood exhaust system. Air flow sensors are costly and non-linear. They are also subject to contamination by the materials in the exhaust air. Pressure sensors are difficult to use because of the very low pressure drops which can exist in the exhaust ducting if the air flow is varied.

Both conventional and by-pass hoods exhaust a fixed amount of air from the room regardless of sash position. As discussed above, the resulting loss of air from the room can waste a lot of energy. To minimize this loss, so-called "add-air" hoods have been developed. An add-air hood includes an additional blower and duct system which supplies air directly to the front of the hood from outside to provide a portion of the make-up air.

Add-air hoods have not proven to be as successful as might be expected at reducing operating costs. The initial installation expense for such hoods is much higher. Additionally, since the make-up air usually requires conditioning to provide reasonable operator comfort, the heating and cooling costs that are saved are often very modest. Furthermore, many conventional and by-pass hoods installations exist which were installed before the recent dramatic increase in energy prices, and adding the extra ducting and associated equipment required by add-air hoods to existing installations can be extremely expensive.

SUMMARY OF THE INVENTION

Briefly, the present invention includes a fume hood controller system in which the sash position is monitored by a transducer which provides a signal indicative of the area of the hood opening. A variable speed controller is responsive to the sash position signal to provide a fan speed which varies in a substantially continuous and linear manner as a function of the sash opening.

A circuit is provided which monitors the power drawn by the motor and which compares the actual power drawn by the motor with the expected power for the present sash position. If the actual power falls below the threshold, an alarm signal is generated indicating a reduced air flow in the fume hood. Additionally, motor overload may be detected by comparing the motor speed control signal with the actual motor speed.

An alternate embodiment is shown in which the present invention may be used to control a single blower which exhausts a plurality of fume hoods while maintaining a substantially constant face velocity in each hood.

DESCRIPTION OF THE DRAWINGS

The operation and advantages of the present invention will be more fully understood with reference to the accompanying figures of which.

DESCRIPTION OF THE PREFERRED EMBODIMENT

Figure 1A:
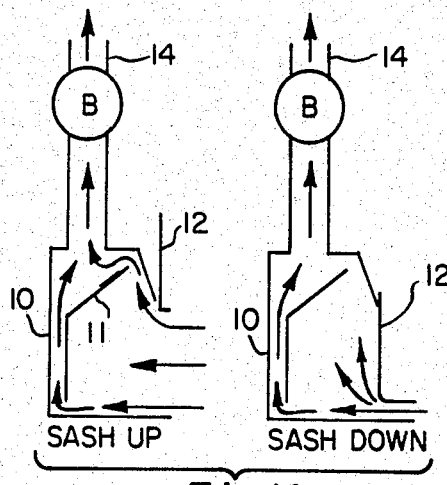
FIGS. 1A, 1B, 1C, and 1D show prior art fume hood systems.

FIG. 1 show three types of prior art fume hoods. A conventional fume hood is shown in FIG. 1A and essentially consists of an enclosure 10 forming five sides of the hood and a sash 12 which slides up and down to provide a variable-sized opening on the sixth side. A baffle 11 is usually provided to control the air flow inside the hood. Air is exhausted from the hood by a blower and blower motor 14. The blower motor is typically an induction motor, which may be single-phase or three-phase, depending on the particular application, and the motor is normally connected to a centrifugal blower fan via a fan belt drive. In this type of hood, the amount of air exhausted by the hood blower 14 is essentially fixed, and the face velocity increases as the area of the sash opening 14 decreases. As a result, the sash must be left open an appreciable amount or a permanently-open by-pass opening which is not closed when the sash is closed must be provided into the hood.

To avoid increasing the face velocity excessively as the sash is closed, some fume hoods include a two speed motor and a switch which is activated by the sash as it is raised and lowered. When the sash is lowered beyond a selected point, the blower motor is switched to low speed. While this arrangement reduces the variation in face velocity, there is still a significant change in face velocity as the sash is moved.

Figure 1B:
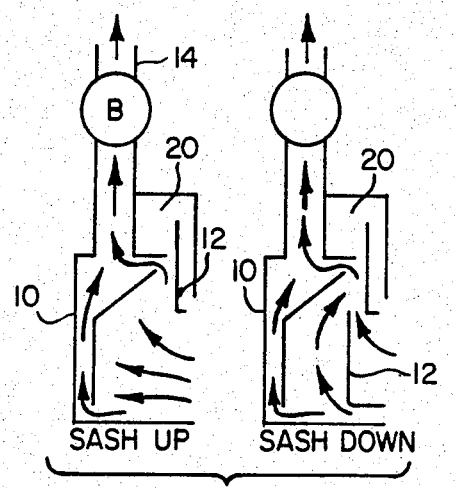
Figure 1C:
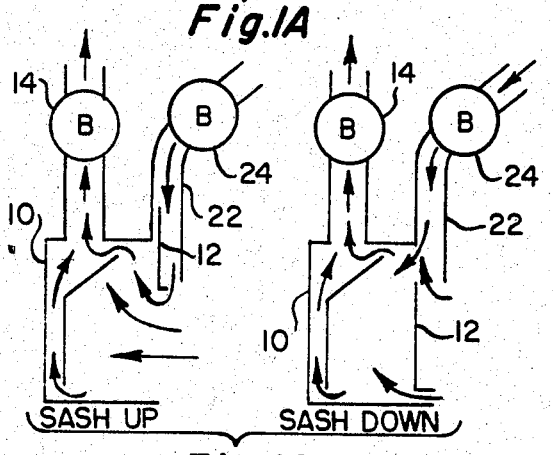

FIG. 1B shows a by-pass hood type of fume hood. A by-pass hood has a second opening 20 through which air can enter the exhaust duct. By-pass opening 20 is blocked by the sash when it is in the fully opened position, as shown in FIG. 1B. As the sash is lowered, the by-pass opening is gradually uncovered so that air can "by-pass" the hood opening and enter the exhaust duct directly, thus preventing the face velocity through the sash opening from becoming too high as the sash is closed. FIG. 1C shows an add-air type of hood, which includes a duct 22 and a second blower 24 which supply air from outside to provide a portion of the make-up air.

Figure 1D:
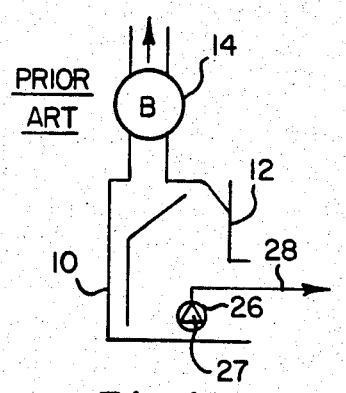

In FIG. 1D, a prior art system is shown in which an air flow sensor 27 is placed in an opening in the fume hood so that it can directly sense the velocity of the air entering the hood. Sensor 27 could be placed in the sash opening or in a separate opening in the side of the hood enclosure 10, as shown by opening 26 in FIG. 1D. In this system, the sensor may be used to control either the blower speed or a damper in the exhaust ducting to control the air flow. As discussed above, this type of system suffers from the expense, nonlinearities, and susceptibility to contamination of the air flow sensor.

Figure 2:
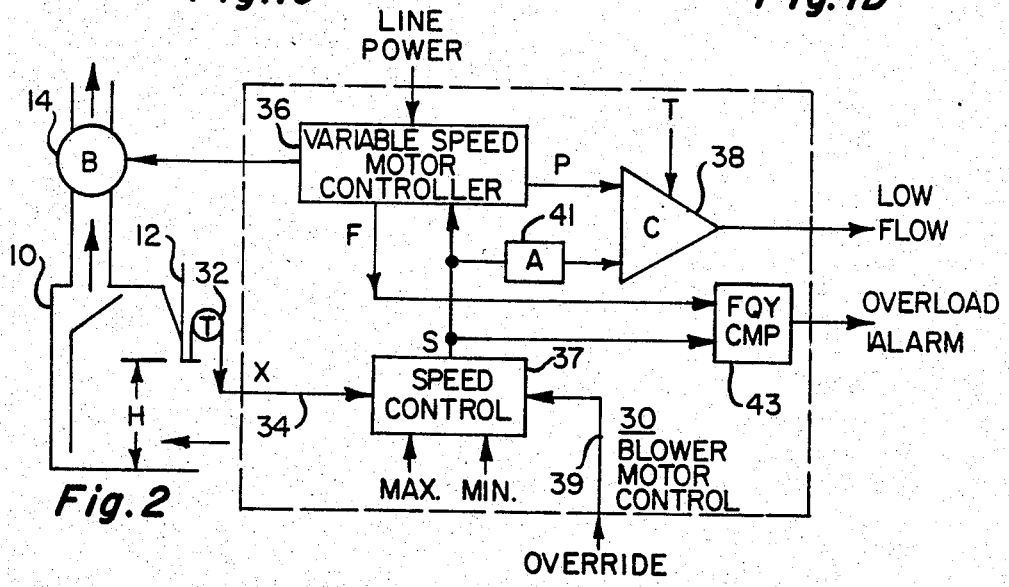
FIG. 2 is a block diagram depicting one embodiment of the present invention.

Referring to FIG. 2, there is shown a block diagram of the present invention as it would be applied to a conventional fume hood. As in conventional hoods, a hood enclosure 10 surrounds the hood working area, and a sash 12 is raised and lowered to provide an opening into the hood. Blower 14 exhausts air from the hood and is controlled by a fume hood controller circuit 30, whose operation will be described below.

The position of sash 12 is monitored by a transducer 32 which provides an output signal x on line 34 which is representative of the hood sash position. In the preferred embodiment described, transducer 32 is implemented by means of a constant tension, spring-return potentiometer, as discussed below. The transducer should provide an output which is a continuous and monotonic function of the sash height, designated as H in FIG. 2. In the preferred embodiment, the transducer provides an output signal X which is proportional to the height H of the sash.

The signal on line 34 is applied to a variable speed motor controller circuit 36 via a speed control circuit 37. In response to the signal from speed control circuit 37, motor controller 36 varies the speed of blower motor 14. Speed control circuit 37 has two inputs, designated as MAX and MIN in FIG. 2, which select the maximum and minimum speeds for the blower motor during normal operation. The MAX and MIN signals may be provided by manually setting potentiometers, although other means may be used. The maximum and minimum speeds are typically selected to provide a range of approximately 15 to 85 percent of the maximum air flow provided by the blower, as discussed in more detail below. As the hood sash 12 is moved up and down, speed control 37 commands the motor controller 36 to vary the blower speed over the selected range. An override signal may also be provided to speed control 37 on line 39. In response, the speed control 37 commands the motor controller to drive blower 14 at maximum speed to provide 100 percent of the maximum air flow. This feature is useful in emergency situations where the hood must be exhausted as rapidly as possible. The override signal may be provided manually or by an automatic sensor which detects a dangerous situation, such as high temperature.

The circuitry described above causes the speed of blower 14 to be varied substantially linearly between the selected minimum and maximum speeds as a function of the sash height H. The fume hood system pressure drop is dominated by the resistance to air flow of the exhaust ducting, and thus appears like a fixed or constant system, until the sash is almost completely closed. Most systems will have a minimum sash opening or a by-pass opening that will set a minimum air flow in the hood to ensure that the hood air is constantly being replaced, and this small opening helps to keep the fixed system assumption valid even for a fully closed sash by keeping the pressure drop across the hood opening small. The fan laws state that for a fixed system, air flow is proportional to fan speed. As a result, the system of FIG. 2 varies the speed of blower 14 so that the air flow from the hood varies linearly as the sash height changes, and thus as the area of the hood opening. In this manner, the face velocity of the air flowing through the hood opening is maintained at an essentially constant value as the sash is raised and lowered.

It is important that the face velocity of a fume hood not be allowed to go below a certain level. A low face velocity may be caused by many conditions, such as a blocked duct or slipping fan belt, and it is important to take immediate steps when a low flow condition exists to prevent escape of contaminants from the hood. In by-pass fume hoods having a fixed fan speed, the air flow in the hood system may be monitored, for example by means of a flow sensor in the exhaust duct, to determine if the air flow and hence face velocity is below a selected value. As discussed above, there are significant reliability problems with the use of such sensors. Furthermore, such systems for monitoring air flow are not readily applicable to the present invention, in which the blower speed and air flow are continuously varied over a wide range.

Centrifugal blowers are characterized by a reduction in the power required as the amount of air moved by the blower decreases for a given fan speed. A blocked duct or other condition which reduces the air flow in the fume hood can be detected by monitoring the power consumed by the blower motor and comparing the power level with an expected power level. Other conditions resulting in a low flow, such as a slipping or broken fan belt, will also reduce the power consumed by the blower motor at a given speed.

As discussed above, for a properly operating system, the blower motor power is proportional to the cube of the fan speed, the pressure drop across the fan is proportional to the square of the fan speed, and the air flow is proportional to the fan speed. Thus to detect a variation from the expected power, the power signal P should be compared with a signal which is proportional to the cube of the speed control signal S. Because of the cubic relationship between power and fan speed, the sensitivity of the circuitry shown in FIG. 2 has a high sensitivity to variations in blower speed. Thus the scaling factor for scaling circuit 41 may be selected to give an adequate margin for such deviations from the theoretical cubic relationship while still maintaining adequate sensitivity to changes in the motor power which indicate a dangerous condition. One means for implementing circuit is shown and described below with reference to FIG. 12.

In FIG. 2, motor controller 36 provides a signal P to one input of a comparator circuit 38 which is proportional to the power being applied to blower motor 14. The speed control signal from circuit 37 is applied through a scaling circuit 41 to a second input of comparator circuit 38. From the discussion above, it can be seen that the blower motor power and the blower fan speed are functionally related to each other. A scaling circuit 41 serves to multiply or scale the speed control signal by a function A which approximates the cubic relationship between fan speed and power. Comparator circuit 38 compares the actual motor power to the speed control signal and provides an output signal when the actual motor power drops below the expected power consumption by a preselected value. A threshold signal T applied to the comparator circuit sets the amount by which the actual power must drop to cause a low flow alarm signal.

The fume hood airflow may also be reduced by conditions which overload the motor or the motor controller. Such conditions include shorted motor leads, reduced drive voltage, excessive bearing friction, or a jammed blower wheel. An overload condition in the motor is indicated by a difference in frequency between the commanded and the actual electrical frequency applied to the motor. The commanded frequency is represented by speed control signal S. Motor controller circuit 36 provides a signal, designated as F in FIG. 2, which is representative of the frequency of the AC signals applied to the blower motor. This signal is applied to one input of a comparison circuit 43.

The speed control signal S is applied to a second input to circuit 43. Comparison circuit 43 compares the commanded frequency with the stator excitation frequency, and provides an output signal representative of an overload condition when the difference frequency exceeds a predetermined value. The above-described operation of the low flow and overload alarm detection circuitry results in a permitted window of operation for the fan motor speed. The circuitry of the present invention detects speeds which are above or below this window and produce an alarm output in response thereto.

Figure 4:
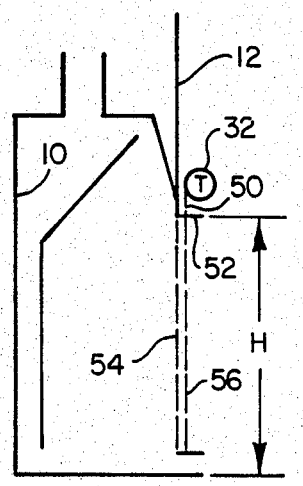
FIG. 4 shows a preferred sash position sensor.

While many different type of transducers may be used with the system of FIG. 2, it has been found that a potentiometer connected to a reel and a constant tension return spring provides a reliable and effective means of indicating sash position. These devices are readily available in materials which are suitable for installation on a fume hood. Additionally, they are particularly suitable to applications in which the fume hood controller of present invention is added to an existing fume hood installation. FIG. 4 shows how such a transducer may be installed.

Figure 3:
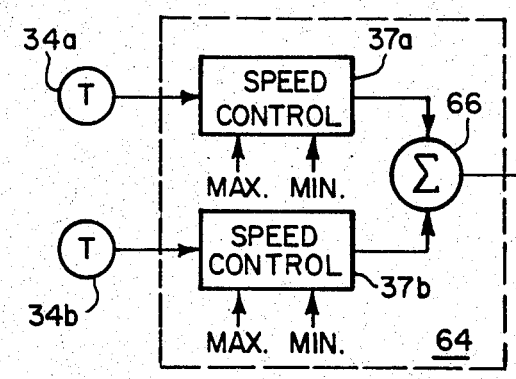
FIG. 3 is a block diagram illustrating how two sash position signals would be combined in a system such as that shown in FIG. 5.

The transducer includes a potentiometer connected to a reel on which a cable is wound. A constant tension spring provides a return force on the reel. When the cable is extended, it unwinds from the reel, and the potentiometer provides an indication of how far the cable has traveled. Referring to FIG. 3, the potentiometer 32 is installed so that the cable 50 may be attached to the hood sash, as shown at 52. When the hood is lowered, as indicated by dotted line 54 in FIG. 4, the cable unwinds, as indicated by dotted lines 56, varying the resistance of potentiometer 32.

It should be noted that the present invention utilizing the transducer shown in FIG. 4 may be easily retrofitted to existing installations. No major modifications to the fume hood or motor are required. The transducer cable may be easily attached to the hood sash in almost all installations. In most cases, the force exerted on the hood sash by the potentiometer return spring is negligible, and at most, a minor adjustment to the sash counterbalance is needed.

Figure 5:
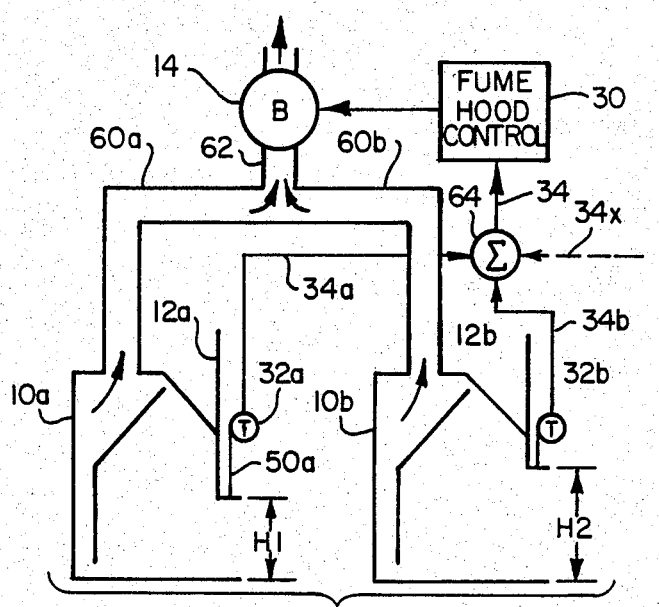
FIG. 5 shows the present invention applied to a fume hood system in which one blower exhausts more than one fume hood.

FIG. 5 shows how the fume hood controller of FIG. 2 may be applied to a fume hood system in which two or more hoods are exhausted through a single blower. In FIG. 5, two fume hoods 10*a* and 10*b* are each connected to respective exhaust ducts 60*a* and 60*b* which, in turn, both feed into a common duct 62 connected to a blower 14. This type of installation is often used in multiple hood installations for economy. Each hood has its own sash position transducer 32*a* and 32*b*. FIG. 5 shows the output signals from transducers 32 being applied on respective lines to a summing circuit 64. The output of summing circuit 64 is equal to the sum of the transducer outputs and, hence, is proportional to the total area of the hood openings. In other words the output signal X from summer 64 is equal to $K_1H_1+K_2H_2$, where $H_1$ and $H_2$ represent the individual sash heights of the two hoods 10*a* and 10*b* and $K_1$ and $K_2$ reflect the width of the hoods. The output signal from summer 64 is applied to the fume hood controller 30 on line 34, as in FIG. 2.

It should be apparent that the signals from transducers 32 may be combined in various ways. The arrangement of FIG. 5 may be extended to more than two fume hoods, as indicated by dotted line 34*x* which represents sash height signals from one or more other hoods. It is preferrable that the signals from each of the hoods should be summed after the processing of the sash signal by speed control 37. This is shown in FIG. 3 in which the output signals from transducers 34*a* and 34*b* are respectively processed by associated speed control circuits 37*a* and 37*b* before being summed in summing circuit 66 to provide the speed control signal S applied to the blower motor controller.

Many different types of blower or motor speed controllers may be used with advantage in the present invention. One type of motor controller circuit which is suitable for use with the present invention and which has advantages over some other types of motor controller circuits is the Self Generative Variable Speed Induction Motor Drive described in U.S. Pat. No. 4,400,655, by William Curtiss and Gordon Sharp, issued August 23, 1983, the contents of which are incorporated herein by reference.

Figure 6:
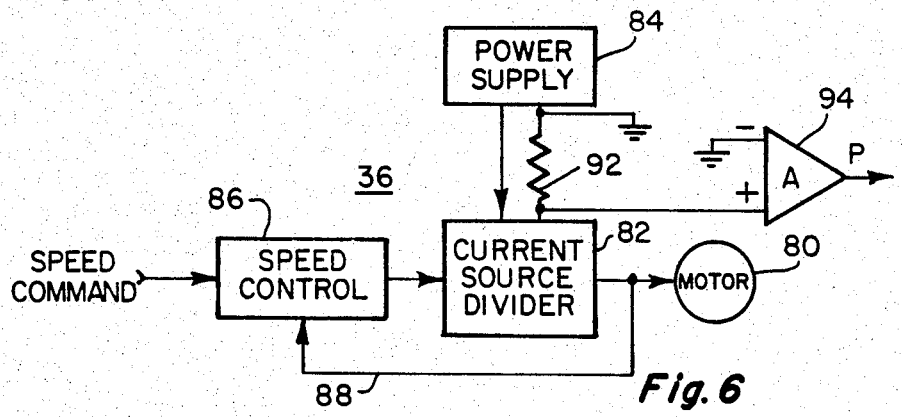
FIG. 6 illustrates a preferred method of deriving the blower power signal.

The above-referenced patent describes a variable speed motor controller which is a current-source type of drive, as opposed to a voltage-source type of drive. The following is a brief description of current-source motor controller with reference to FIG. 6, which shows a generalized block diagram of this type of controller. In FIG. 6, the stator windings of a three-phase motor 80 are driven by a current source driver circuit 82. Power to the motor is supplied by a power supply circuit 84 via driver circuit 82. The motor driver circuit is a switching type of circuit and dissipates little power.

The frequency of the signals applied to the stator windings, which is closely related to motor speed, is determined by speed control circuitry 86. The instantaneous electrical excitation frequency is self generated from the voltage produced across the stator windings. This frequency is monitored and fed back on line 88 to the speed control circuitry 86 where it is compared with the desired speed, and the amplified error is used to control the drive current amplitude applied to the stator windings. In this manner closed loop control of the motor speed is provided. A speed command signal is applied to the speed control circuitry 86 on line 90. In the present invention, the speed control signal on line 90 is the output signal from speed control circuit 37 shown in FIG. 2.

Using a motor controller such as that shown in FIG. 6 with the present invention has several advantages over some other types of controllers. First, the controller of FIG. 6 provides closed-loop control of the motor speed without requiring a tachometer or other separate speed sensor attached to the motor. This increases the reliability of the fume hood controller, since a separate motor speed sensor may deteriorate in the environment of fume hood contaminants. Additionally, the fume hood controller may be added to an existing fume hood system without the necessity of adding a motor speed sensor.

Second, the power signal P in FIG. 2 may be easily derived from the control circuit of FIG. 6. Induction motors frequently operate with large power factors. As a result, the power applied to a motor may not be equal to the product of the stator voltage and current, and providing a signal representative of the power actually dissipated in the motor is difficult to do from the stator winding waveforms. Since the motor driver circuit dissipates little power itself, the motor power may determined by measuring the power into the driver circuit 82. In the motor controller shown in FIG. 6, the input to driver circuit 82 from the supply 84 is a variable current at a substantially constant voltage. By measuring the average current supplied to the driver circuit, a signal proportional to the actual motor power dissipation can be easily derived. In the embodiment described, the current is measured by means of a small resistor 92 in the return lead to the power supply. The average voltage drop across resistor 92 is proportional to the average current supplied to the motor driver circuit 82, and hence to the average motor power. The voltage across resistor 92 is amplified by a buffer/filter amplifier 94 to provide the power signal P of FIG. 2.

The fume hood controller shown in FIG. 2 may be used with various types of motor controller circuits other than that shown in FIG. 6, including controllers for both single-phase and three-phase induction motors. The selection of an appropriate circuit and the application of the present invention to such circuits is within the ordinary skill of those in the art, and the designation of a preferred type of motor controller herein should not be construed as a limitation on the present invention.

Figure 7:
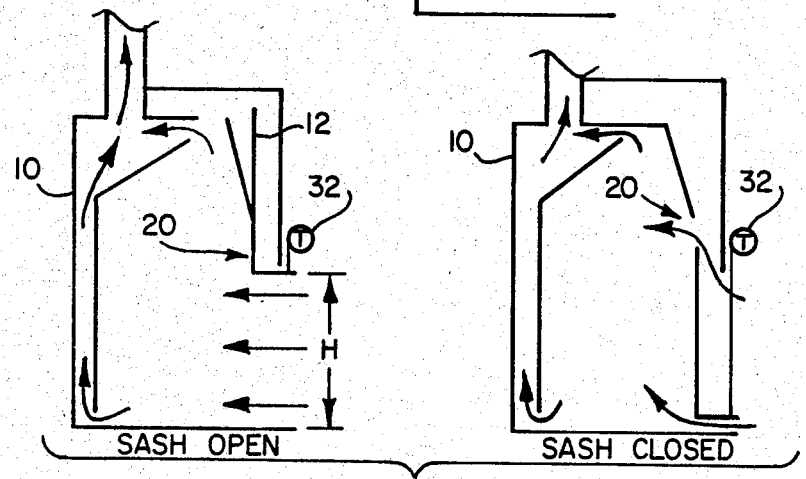
FIG. 7 shows the invention used with a by-pass type of hood.

Referring to FIG. 7 an alternate embodiment of the invention is shown which is suitable where it is desirable to have some by-pass air into the fume hood when the sash is down. In FIG. 7, a fume hood 10 has a by-pass opening 20 which is covered by the sash when it is up. In contrast with conventional by-pass hoods, the by-pass opening does not start to become uncovered until the sash is almost completely closed. A typical system might have the by-pass start to become effective when the sash is eighty percent down. In other words, the by-bass is eliminated from the system after the hood sash has been raised by 20 percent of its total travel.

Figure 8:
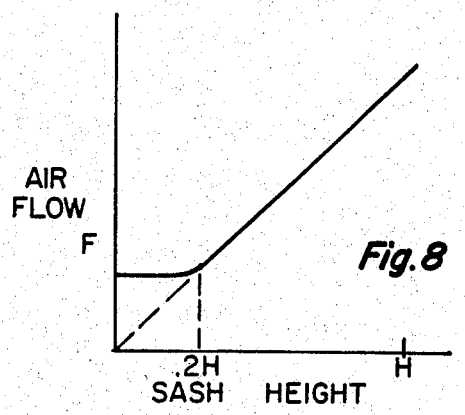
FIG. 8 is a graph showing air flow versus sash height for the system shown in FIG. 7.

The air flow versus sash height curve for the system of FIG. 7 is shown in FIG. 8. If the maximum sash height is designated as H, as shown in FIGS. 7 and 8, the air flow to maintain a constant face velocity is a linear function of sash height for the range 0.2H to H. Through this range the fume hood controller operates in the same manner as described above in connection with FIG. 2. The blower motor speed is proportional to sash height and to the output of speed control 37. As the hood is lowered below 0.2H, the air flow should level off to a constant value, as shown in FIG. 8, in order to keep a constant face velocity. This airflow control is accomplished by appropriately setting speed control 37 of FIGS. 2 or 10. In general, the ratio of the by-pass area to the total area of the hood opening must be matched to the ratio of the minimum flow desired to the maximum flow desired to keep a constant face velocity. In some cases it may be desirable to design the fume hood so that the bypass area can be easily adjusted to match these ratios once the minimum and maximum flows have been picked.

An alternate, though less energy efficient, bypass arrangement is one where there is a fixed bypass opening, i.e., an opening into the hood having a constant area which does not vary as the sash is moved. Such a fixed bypass may be used with or without a modulated bypass of the type discussed above in connection with FIGS. 7 and 8. In either case, the invention can still be used to achieve a constant face velocity by adjusting the characteristics of speed control 37 so that the fan speed and thus the air flow is varied roughly proportionally to the total area of all the hood openings, including sash opening, fixed openings or bypasses, and modulated bypasses.

Figure 9:
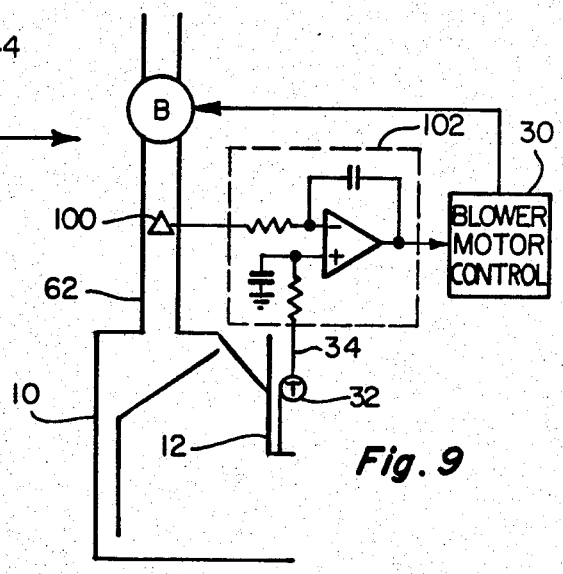
FIG. 9 shows a modification of the transducer circuit which is used with a by-pass system such as that shown in FIG. 7.

The operation of the embodiment of the present invention described in connection with FIG. 2 above depends upon a relatively linear relationship between the blower motor speed and the air flow. This relationship holds true only if the pressure difference between the hood interior and the building exterior remains solely a function of the hood air flow. In some applications, this may not hold true. One example of such an application is where there is a significant negative pressure drop form outside to inside a building caused by many operating fume hoods and an insufficient make-up air supply. This situation would produce a back pressure that would reduce air flow when the pressure drop of the fan becomes comparable to the back pressure, as might be the case for low fan speeds. FIG. 9 shows an alternate embodiment of the present invention which compensates for such a situation.

In FIG. 9, the exhaust air flow is monitored by an air flow sensor 100 located in the exhaust duct, and a signal representative of the air flow is applied to one input of a circuit such as a differential integrator circuit 102. The output signal from transducer 32, which is representative of the desired air flow is applied to the second input to integrator 102. The output of integrator 102 is applied to the blower motor control circuit 30 in place of the transducer output signal X of FIG. 2. The operation of integrator 52 produces an integrator output signal which will cause the blower motor control circuit to increase the blower motor speed until the output signal from air flow sensor 100 equals the output signal from transducer 32, or, in other words, until the actual air flow equals the desired air flow.

Figure 10A:
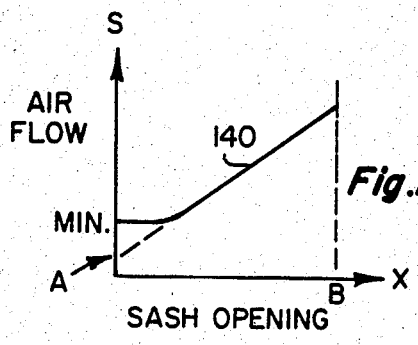
FIG. 10A is a graph of air flow versus sash opening for the system of FIG. 10.
Figure 10:
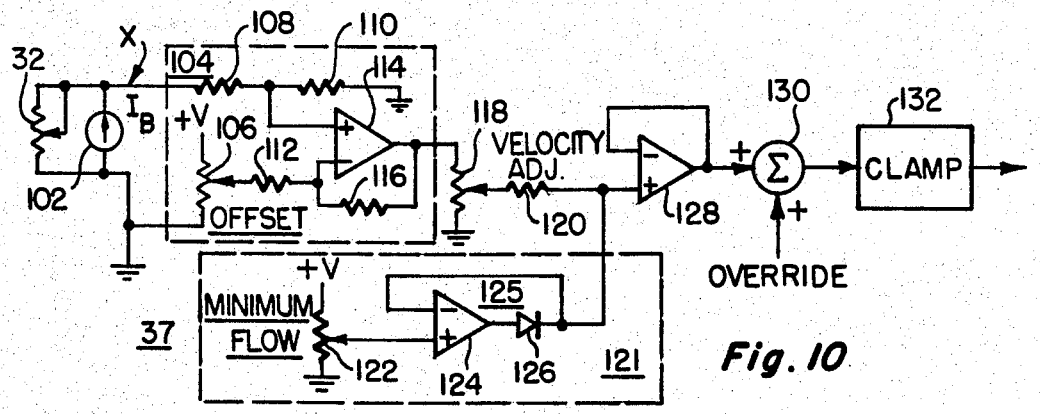
FIG. 10 shows one circuit for implementing the speed control circuit of FIG. 2.

Referring to FIG. 10, there is shown one means of implementing speed control circuit 37. In FIG. 10, a transducer 32 includes a potentiometer wired as a variable resistance. Transducer 32 is driven by a current source 102 to provide a voltage across the transducer terminals which varies linearly with the sash opening. The voltage across transducer 32 is applied to the input of an amplifier circuit 104. The input impedance of amplifier 104 is sufficiently larger than the maximum resistance of the transducer potentiometer that negligible current is drawn from current source 102. Amplifier 104 includes an offset adjustment to add a bias to the output voltage. In amplifier 104, this is accomplished by referencing the inverting input of op-amp 114 to a voltage which may be varied between ground and a preselected positive voltage by an adjustable potentiometer 106. The offset adjustment is explained below.

The output signal from amplifier circuit 104 is applied to one end of a potentiometer 118. The other end of potentiometer 118 is connected to ground. By varying the setting of potentiometer 118, the effective gain of amplifier may be adjusted.

The signal from the wiper of potentiometer 118 is applied via a resistor 120 to the non-inverting input of an op-amp 128 which has its output connected to its inverting input to form a unity gain buffer. The non-inverting input of buffer 128 is also connected to a clamp circuit 121 which serve to prevent the signal applied to op-amp 128 from going below a preset voltage.

The clamp circuit includes an op-amp 124 whose non-inverting input is connected to a variable voltage reference provided by potentiometer 122. Potentiometer 122 selects the minimum flow for the hood. The output of the op-amp is connected to its inverting input and to buffer 128 through a diode 126. Op-amp 124 maintains the voltage at the connection of diode 126 and buffer amplifier at a voltage no less than the voltage at the wiper of potentiometer 122. If the input to buffer 128 goes below this voltage, op-amp 124 sources current through diode 126 to maintain the input to buffer 128 at the selected level. When the input to buffer is above this voltage, diode 126 is reverse biased, effectively disconnecting clamp circuit 121 from the input to buffer 128.

The output of buffer 128 is summed with the override signal in a summing circuit 130. The output of summing circuit 130 is applied to clamp circuit 132 which limits the output signal S to less than a predetermined voltage level. The override signal is large enough to cause the output of summing circuit 130 to exceed the clamp voltage so that the speed control signal S goes to its maximum value when the override signal is present.

FIG. 10A is a graph illustrating the operation of the circuit of FIG. 10. The speed control signal S, representative of the desired air flow for the bypass arrangement of FIG. 7, is shown as a function of the linear sash position signal X by line 140. The minimum air flow is selected by potentiometer 122. The air flow will remain at this level for sash openings less than a certain amount.

The maximum air flow at the full sash opening (assuming the absence of an override signal) is determined by the settings of the velocity adjust potentiometer 118 and offset potentiometer 106. The velocity adjustment controls the slope of line 140. The offset adjustment controls the intersection of line 140 and the vertical axis in the absence of the clamp circuit 121. It should be apparent that any desired minimum flow, maximum flow and breakpoint for the graph of FIG. 10A can be achieved by appropriately adjusting potentiometers 106, 120, and 122. These adjustments allows a constant face velocity to be maintained by making the blower speed, and hence the air flow, roughly proportional to the total area of all the hood openings, (including the sash opening and any fixed or variable bypass openings which may be present) for any sash position.

Figure 11:
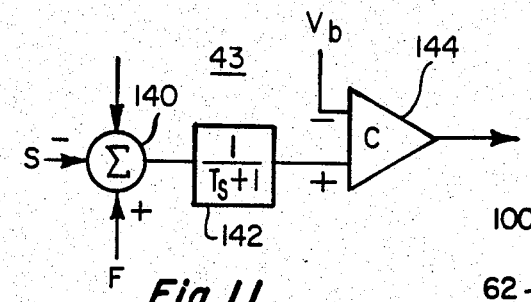
FIG. 11 shows one circuit for implementing the frequency comparison circuit of FIG. 2.

FIG. 11 shows one circuit for implementing the frequency comparator circuit 43 of FIG. 2. The S signal, representing the desired fan speed, and the F signal, representing the actual fan speed, are applied to a difference circuit 140. The output of difference circuit 140 represents the instantaneous difference between the F and S signals and is applied to a filter circuit 142. Filter circuit 142 is a low pass filter with a time constant on the order of several seconds and may be implemented, for example, by the lag network shown in FIG. 11. The output of filter 142 is applied to one input of a comparator circuit 144. The other input to comparator circuit is a reference voltage $V_b$ which sets the frequency difference required to produce an alarm signal. The low pass filter 142 has a time constant sufficiently long so that the overload alarm is not triggered by transient errors in the commanded and actual frequencies of the motor. Such a transient error would occur, for example, when the sash is suddenly lifted and blower motor is suddenly commanded to increase the blower speed.

Figure 12:
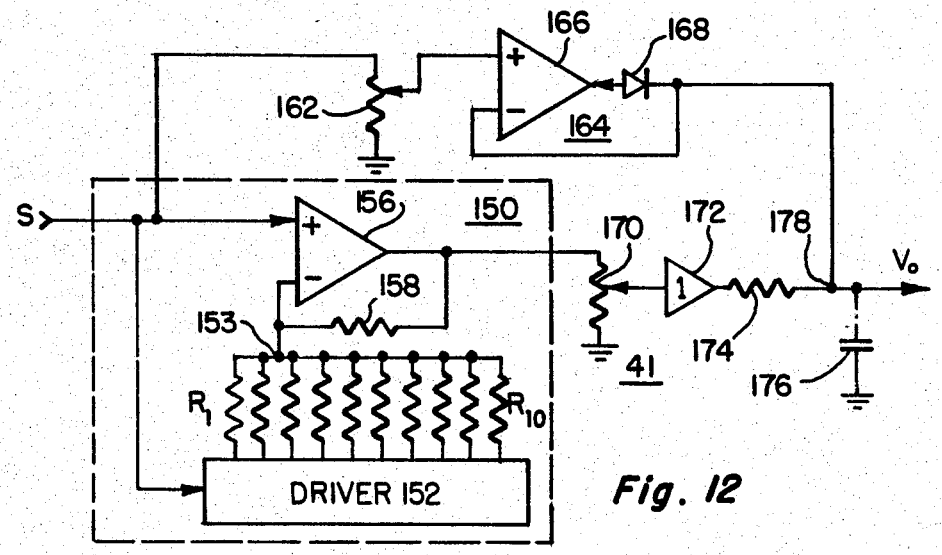
FIG. 12 shows one circuit for implementing the scaling circuit of FIG. 2.

As discussed above, the relationship between fan speed and power is cubic, and a circuit such as circuit 41 in FIG. 2 is necessary to provide a signal which is representative of the cube of the commanded speed. In actual practice, at very low fan speeds, the losses inherent in the motor drive circuit, motor and fan bearings, and the belt drive exceed the power required to drive the fan. These losses are roughly proportional to the motor speed. As the fan speed increases, the power drawn by the blower motor changes from a linear function of motor speed to a cubic function. FIG. 12 shows one circuit by which such a transfer function can be realized.

In FIG. 12, the input voltage S is applied to the input of a circuit 150 which produces an output voltage which is related to the input voltage by a cubic function. There are many circuits known to those in the art for realizing such circuits. In FIG. 12, circuit 150 is implemented as a piecewise-linear approximation of a cubic function in the following manner. The S signal is applied to the input of a display driver circuit 152, such as a National Semiconductor LM3914. Ten resistors R1 through R10 each have one end connected to driver circuit 152 and their other ends are connected together at node 153. At the input signal to driver circuit 152 increases, resistors R1 through R10 are successively connected to ground.

The S signal is also applied to the non-inverting input of an op-amp 156. The inverting input of op amp 156 is connected to its output via resistor 158, and the inverting input is also connected to resistors R1 through R10 at node 153. The effective resistance between node 153 and ground is determined by the values of R1 through R10 and by the operation of driver circuit 152 which selectively connects R1 through R10 to ground. Since R1 through R10 are in the feedback path of op-amp 156, they determine the gain of circuit 150. By choosing the proper values for resistors R1 through R10, a cubic relationship between the input and output voltages of circuit 150 may be easily achieved.

The output signal from circuit is applied to the input of a unity-gain buffer amplifier 172 via a potentiometer 170. potentiometer 170 effectively varies the gain through circuit 150. The output of buffer 172 is applied via a resistor 174 to node 178, from which the output signal $V_o$ is taken. A capacitor 176 is connected between node 178 and ground. The RC network 174–176 serves to filter out any transients which may be produced by the operation of driver circuit 152.

The S input signal is also applied via a potentiometer 162 to clamp circuit 164. Clamp 164 is made up of op-amp 166 and diode 168 connected in the forward conducting direction between the output and the inverting input of op-amp 166. The output of clamp circuit 164 is applied to the output node 178. The clamp circuit operates similarly to clamp circuit 125 described above in reference to FIG. 10, with the exception that the input to clamp circuit 164 is the S signal, rather than a fixed reference voltage. Thus the output from clamp 164 operates to keep the output signal $V_o$ at or above a level which is proportional to the input signal, the proportionality constant being determined by potentiometer 162. As will be seen below, by changing the setting of potentiometer 162, circuit 41 may be adjusted to properly represent the friction and other losses which predominate at low speed and which are proportional to motor speed.

Figure 13:
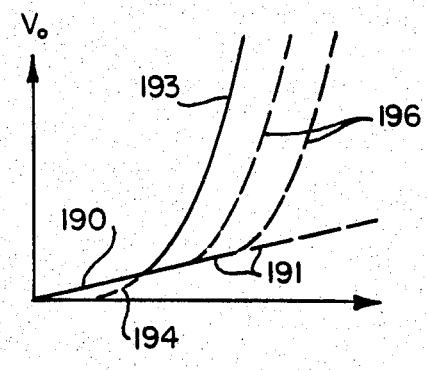
FIG. 13 is a graph of air flow versus speed control signal for the circuit of FIG. 12.

The operation of circuit 41 may be more easily understood with reference to the graph of of FIG. 13. In FIG. 13, the input signal S is represented by the horizontal axis, and the output signal $V_o$ is shown on the vertical axis. The straight line made up of solid line segment 190 and dotted line segment 191 represents the output voltage from clamp circuit 164, i.e. the voltage below which clamp circuit 164 prevents the output from falling. The cubic function made up of solid line segment 193 and dotted line segment 194 represents the output from circuit 150 for a given setting of potentiometer 170. Since the clamp circuit output is only a lower bound on the output voltage $V_o$, the actual transfer function of the circuit shown in FIG. 12 is shown by the solid curve 190 and 193. Adjusting the setting of potentiometer 170 varies the magnitude of the output signal from circuit 150. As the setting of potentiometer 170 is reduced, the transfer function of circuit 41 will vary in the manner shown by dotted line segments 196, thus effectively varying the point at which the transfer function changes from a linear relationship, representing the motor, drive, and friction losses, to a cubic function, representing the power required to exhaust the air in the fume hood.

There has been described a new and useful system for controlling a fume hood blower motor to achieve a substantially constant face velocity. Modifications to the embodiments described herein may be made by those of ordinary skill in the art in applying the teachings of the present invention to different situations and applications. Accordingly, the description herein of a preferred embodiment for the purpose of illustrating the invention should not be taken as a limitation on the invention. Rather, the invention should be interpreted in accordance with the following claims.

What is claimed is:

1. A fume hood controller for controlling the speed of a fume hood blower as the fume hood sash is moved, comprising:

transducer means responsive to the position of the fume hood sash for producing a sash opening signal the value of which is a substantially continuous and monotonic function of the sash opening;

speed control means, responsive to the sash opening signal, for producing a speed control signal representative of blower speed, the speed control signal having a function of the sash opening signal; and blower drive means, responsive to the speed control signal, for causing the blower to rotate at the speed represented by the speed control signal.

2. The fume hood controller of claim 1 wherein the blower drive means includes:

a blower motor;

means for connecting the blower motor to the blower so that the blower motor can rotate the blower;

motor drive means responsive to the the speed control signal for applying signals to the blower motor to cause the blower to rotate at the speed representated by the speed control signal.

3. The fume hood controller of claim 2 further comprising:

means for monitoring the power applied to the blower motor and for producing a power signal representative thereof;

alarm means, responsive to the power signal and to a signal representative of motor speed, for comparing the actual power required by the blower motor with the power expected to be required by the motor at a particular speed and for providing an alarm signal upon detection of a variance therebetween.

4. The fume hood controller of claim 3 wherein the alarm means further includes:

means for setting a threshold;

scaling means responsive to the speed control signal and having a transfer function so as to provide an output signal which is an approximation of a cubic function of the speed control signal over at least a part of its range; and means for comparing the scaling means output signal with the power signal and for producing an alarm signal when the scaling means output signal exceeds the power signal by an amount in excess of the threshold.

5. The fume hood controller of claim 3 wherein the motor drive means includes:

motor controller means, responsive to the speed control signal, for applying signals to the blower motor to cause the motor to rotate the blower at the speed representated by the speed control signal;

power supply means for supplying power to the motor controller means, the power being supplied as a a variable current at a substantially constant voltage; and means for measuring the average current level applied to the motor controller means and for providing a signal proportional to said average current level as the power signal.

6. The fume hood controller of claim 3 wherein the motor controller means further includes means for detecting if the blower motor is overloaded and for producing an overload signal in response thereto.

7. The fume hood controller of claim 3 wherein the speed control means further includes:

means for setting a minimum speed;

means for setting a maximum speed; and means for varying the speed control signal so that the motor varies in speed between the minimum speed and the maximum speed as the sash is moved between its minimum and maximum openings.

8. The fume hood controller of claim 7 wherein the means for varying varies the speed control signal applied to the motor drive means as a substantially linear function of area of the the sash opening over at least a part of the range of the sash opening signal.

9. The fume hood controller of claim 8 wherein the speed control means further includes overspeed means, operative in response to an overspeed signal, for applying signals to the blower motor to cause the blower motor to rotate at a speed in excess of said maximum speed.

10. The fume hood controller of claim 2 wherein the transducer means includes a variable resistor connected to the sash so that the resistance varies as the sash is moved.

11. The controller of claim 10 wherein the transducer means comprises:

a cable having one end connected to the fume hood sash; and a constant-tension, spring-return, cable-driven potentiometer, including a reel to which is attached the cable so that the potentiometer is varied by the cable unwinding and winding on the reel as the sash moves.

12. The fume hood controller of claim 2 wherein the speed control means varies the speed control signal applied to the motor drive means as a substantially linear function of area of the the sash opening over at least a part of the range of the sash opening signal.

13. The fume hood controller of claim 2 wherein the speed control means further includes:

means for setting a minimum speed;

means for setting a maximum speed; and means for varying the speed control signal so that the motor varies in speed between the minimum speed and the maximum speed as the sash is moved between its minimum and maximum openings.

14. The fume hood controller of claim 13 wherein the speed control means varies the speed control signal applied to the motor drive means as a substantially linear function of area of the the sash opening over at least a part of the range of the sash opening signal.

15. The fume hood controller of claim 14 wherein the transducer means includes a variable resistor connected to the sash so that the resistance varies as the sash is moved.

16. The fume hood controller of claim 2 wherein the speed control means further includes overspeed means, operative in response to an overspeed signal, for applying signals to the blower motor to cause the blower motor to rotate at a speed in excess of said maximum speed.

17. The controller of claim 1 wherein the transducer means comprises:

a cable having one end connected to the fume hood sash; and a constant-tension, spring-return, cable-driven potentiometer, including a reel to which is attached the cable so that the potentiometer is varied by the cable unwinding and winding on the reel as the sash moves.

18. The controller of claim 1 wherein the transducer means includes a variable resistor connected to the sash so that the resistance varies as the sash is moved.

19. In a fume hood installation having: a plurality of fume hoods each including a sash which moves to provide an opening for access to the fume hood interior; an exhaust blower driven by a blower motor; and exhaust ducting connecting each of the fume hoods to the blower; a fume hood controller, comprising;

a plurality of transducer means, equal in number to the number of fume hoods and each transducer being associated with a respective one of the fume hoods, for providing sash opening signals representative of the amount by which the sash of the associated fume hood is open;

means for combining the sash opening signals from the plurality of transducers to provide an intermediate signal representative of the combined areas of the openings into the plurality of fume hoods;

speed control means, responsive to the intermediate signal, for producing a speed control signal representative of blower motor speed, the speed control signal being a function of the intermediate signal; and motor drive means, responsive to the speed control signal, for applying signals to the blower motor to cause the motor to rotate at the speed represented by the speed control signal.

20. The fume hood controller of claim 19 wherein the each of transducers includes means for providing a variable resistance between two terminals, the resistance varying as a substantially linear function of the area of the respective sash opening.

21. The fume hood controller of claim 20 wherein each of the transducers includes a constant-tension, spring-return, cable-driven potentiometer.

22. The fume hood controller of claim 19 wherein the each of transducers includes means for providing a variable voltage as the sash opening signal, the voltage varying as a substantially linear function of the area of the respective hood opening; and wherein the means for combining includes means for summing the voltages provided by the transducers and for providing a speed control signal which is proportional to the sum of the variable voltages.

23. A fume hood, comprising:

an enclosure;

means for providing access into the interior of the enclosure, including a movable sash which moves over a travel range from a minimum opening to a maximum opening to provide an opening into the hood of variable area;

a by-pass opening which provides an opening through which air can enter the enclosure;

means for closing the by-pass opening so that it is closed by the sash while the sash position is above a predetermined height in its travel range;

means for opening the by-pass opening when the sash position is below the predetermined height so that the area of the by-pass opening increases by substantially the same amount as the area of the sash opening decreases as the sash moves below the predetermined height, whereby the combined area of the by-pass opening and the sash opening is constant when the sash is below the predetermined height;

a blower driven by a blower motor;

exhaust duct means for connecting the enclosure and the blower so that the blower can exhaust air from the enclosure;

transducer means responsive to the position of the fume hood sash for producing a sash opening signal the value of which varies as a function of the sash opening;

means, responsive to the sash opening signal, for providing an intermediate signal which is substantially proportional to the area of the sash opening when the sash is above said predetermined height and which is substantially constant when the sash is below said predetermined height;

speed control means, responsive to the intermediate signal, for producing a speed control signal representative of blower speed, the speed control signal being a linear function of the intermediate signal over at least a portion of the range of the intermediate signal; and blower drive means, responsive to the speed control signal, for causing the blower to rotate at the speed represented by the intermediate signal.

24. The fume hood of claim 23 wherein the enclosure further includes an opening of fixed size through which air can enter the enclosure.

25. A fume hood, comprising:

an enclosure;

means of or providing access into the interior of the enclosure, including a movable sash which moves to provide an opening of variable area;

a blower driven by a blower motor;

an exhaust duct connecting the enclosure and the blower so that the blower can exhaust air from the enclosure;

sensor means for measuring the volume of the air flow in the exhaust duct and for providing an air flow signal representative thereof;

transducer means responsive to the position of the fume hood sash for producing a sash opening signal the value of which varies as a function of the area of the sash opening;

speed control means, responsive to the sash opening signal and to the air flow signal, for producing a speed control signal representative of a motor speed which will cause an exhaust air flow volume proportional to the area of the sash opening; and motor drive means, responsive to the speed control signal, for applying signals to the blower motor to cause the motor to rotate at the speed represented by the speed control signal.

* * * * *